US005386914A

United States Patent [19]

Erämaja et al.

[11] Patent Number: 5,386,914

[45] Date of Patent: Feb. 7, 1995

[54] APPARATUS FOR SCATTERING FIBROUS MATERIAL, E.G. CHIPS

[75] Inventors: Markku Erämaja; Pentti Raura, both of Valko; Jarmo Sali, Ummeljoki, all of Finland

[73] Assignee: Defibrator Loviisa Oy, Valko, Finland

[21] Appl. No.: 139,618

[22] Filed: Oct. 18, 1993

Related U.S. Application Data

[63] Continuation of Ser. No. 785,336, Oct. 30, 1991, abandoned.

[30] Foreign Application Priority Data

Oct. 30, 1990 [FI] Finland ..... 905361
Sep. 25, 1991 [FI] Finland ..... 914515

[51] Int. Cl.[6] ..... B07B 13/07
[52] U.S. Cl. ..... 209/673; 209/235
[58] Field of Search ..... 209/235, 673, 670, 668, 209/254, 255, 236, 667, 671; 264/113, 121, 518; 425/80.1, 81.1, 83.1; 198/382

[56] References Cited

U.S. PATENT DOCUMENTS 2,912,723 11/1959 Roberts ..... 425/83.1 X
3,117,671 1/1964 Pearce et al. ..... 209/671
3,864,066 2/1975 Gerhardt ..... 425/83.1 X
4,063,858 12/1977 Axer et al. ..... 264/113 X
4,102,502 7/1978 Vaplon et al. ..... 209/673 X
4,903,845 2/1990 Artiano ..... 209/671
5,012,933 5/1991 Artiano ..... 209/671
5,078,274 1/1992 Brown ..... 209/673 X

FOREIGN PATENT DOCUMENTS 37080 10/1968 Finland .
37374 5/1969 Finland .
65571 2/1984 Finland .
73167 5/1987 Finland .
2535382 2/1977 Germany .
2535461 2/1977 Germany .
2742566 3/1979 Germany .
3017396 11/1981 Germany .
3731322 3/1988 Germany ..... 198/382

*Primary Examiner*—David H. Bollinger
*Attorney, Agent, or Firm*—Helfgott & Karas

[57] ABSTRACT

An apparatus for scattering fibrous material, e.g., chips or the like, to form a precisely controlled blanket of chips, together with a binder, onto a scattering band conveyor or a mold, includes a scattering chamber including a dosing conveyor for transferring the material to be scattered toward the discharge end of the scattering chamber. The apparatus is further implemented by arranging to the discharge end of the scattering chamber, next to the dosing conveyor, a roll set comprised of at least three rolls aligned mutually parallel, whereby slots of individually adjustable width are formed between the rolls.

10 Claims, 4 Drawing Sheets

APPARATUS FOR SCATTERING FIBROUS MATERIAL, E.G. CHIPS

This is a continuation of application Ser. No. 785,336, filed Oct. 30, 1991, now abandoned.

BACKGROUND OF THE INVENTION

The present invention relates to an apparatus for scattering fibrous material, e.g., chips or the like to form a precisely controlled blanket of chips, together with a binder, onto a scattering band conveyor or a mold. The apparatus of this type comprises a scattering chamber including a dosing conveyor for transferring the material to be scattered toward the discharge end of the scattering chamber.

In the fabrication of, for instance, chipboard products the blank is formed with the help of material scattering, in which process a mix of chips and binder is fed, e.g., onto a conveyor belt or into a mold in order to form a blank. The blank is next pressed into a board in a continuously operating press, or alternatively, cut and transferred to a plate press in which the blanket of chips and binder is pressed into a chipboard. The present problem in the chipboard fabrication is how to attain such an optimal scattering of the mix of the chips and binder that forms an even blanket on the conveyor belt. Furthermore, the scattering should take place so that the ready-pressed chipboard has the coarser fraction of the chips in the middle of the board, while the finer fraction settles on both outer surfaces of the board. To attain these goals, different methods are applied today. E.g., blowing is commonly used to fractionate the mix of chips and binder. Blowing, however, easily leads to uncontrolled turbulence and unsatisfactory final result. Furthermore, blowing consumes a lot of energy.

SUMMARY OF THE INVENTION

It is an object of the present invention to improve the scattering method so as to achieve a maximally homogeneous placement of the mix of chips and binder onto the molding platform prior to pressing, even so that the finer fraction concentrates to the outer surfaces of the board, while the coarser fraction concentrates to the middle of the board.

This and other objects have been attained by virtue of an invention characterized in that to the discharge end of the scattering chamber, after the dosing conveyor, there is connected a set of rolls comprised of at least three mutually parallel rolls, whereby slots of individually adjustable width are formed between the rolls.

In a preferred embodiment of the invention, the slots become wider toward the end of the set of rolls.

In a further preferred embodiment of the invention, the rolls are made of metal, synthetic material or of elements, and their grooved surface texture is produced by milling, turning, resin casting or other similar method.

Another in a yet further preferred embodiment of the invention, the rolls are aligned parallel in a single plane, said plane being inclined so that the lowermost edge of the plane is at that end of the scattering chamber which houses the dosing conveyor.

The roll assembly according to the invention achieves several benefits over conventional techniques. For instance, fractionation of chips resulting in screening of fine chips' fraction from the coarse chips' fraction is improved. The finer fraction of chips is screened at the feed end of the roll set to fall onto the forming blanket, while correspondingly the fraction screened to fall at the exit end of the roll set is dominatingly comprised of coarser chips. The screened fraction of chips falls through the slots between the rolls. The widths of the slots are determined by the requirements set on the fractionation efficiency and capacity. Removal of reject particles is also possible from the fractionated chips, because rejects are prevented from falling through the slots between the rolls, but are instead conveyed along the upper side of the roll set to a screw conveyor or similar removal apparatus arranged to the exit end of the roll set. Such undesirable particles are, e.g., hard lumps of binder material or metal and other objects carried along with the flow of chips. The roll set smoother out irregularities in the chip flow, thus yielding a homogeneity in the distribution of the scattered chips superior to conventional methods. In combination with scattering with the help of blowing or mechanical means, the present arrangement attains higher capacity than that available by conventional methods. The above-described benefits are accentuated in conjunction with continuously operating presses. Such presses set heavy demands on homogeneity and precision in the scattering of chips.

BRIEF DESCRIPTION OF THE DRAWINGS

The invention is next examined in greater detail with the help of exemplifying embodiments by making reference to attached drawings, in which.

DETAILED DESCRIPTION OF THE PREFERRED EMBODIMENTS

Figure 1:
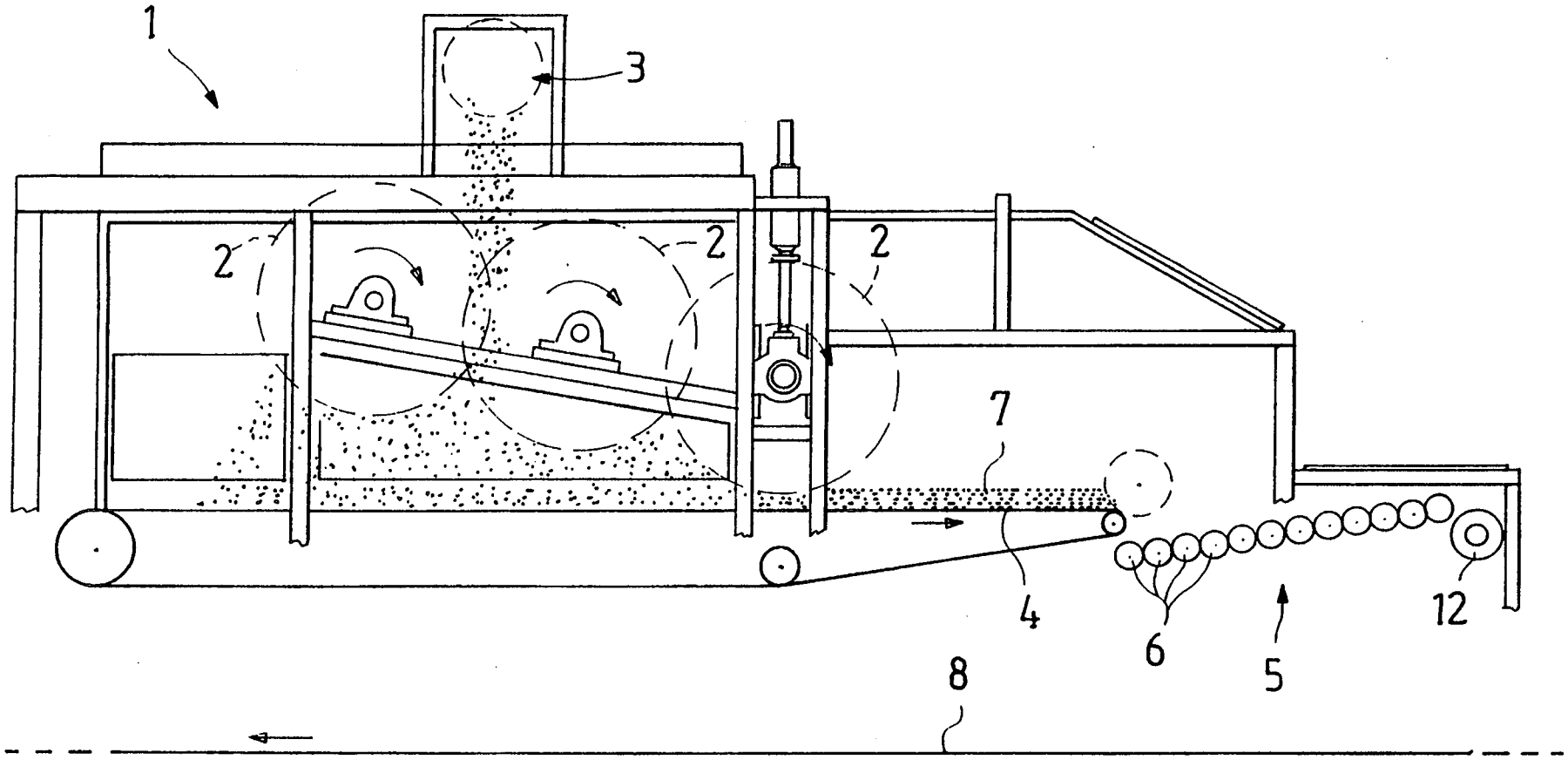
FIG. 1 shows diagrammatically a conventional scattering chamber and a roll set according to the invention arranged into said chamber.

FIG. 1 illustrates a scattering chamber 1, which in the present case is comprised of three rotating peg rolls 2. The mix of a fibrous material, advantageously chips, and binder is fed onto the peg rolls from a feeder apparatus 3 as illustrated in FIG. 1. The scattering chamber further includes a dosing conveyor 4 comprised of an endless belt moving in the direction indicated by the arrow. Onto this belt is formed a chip blanket 7, which is levelled to very fine smoothness by means of the peg rolls while moving toward the discharge end of the scattering chamber.

To the discharge end of the scattering chamber is arranged a roll set 5 comprised of several, at least three, mutually parallel rolls 6, which are aligned orthogonally to the transfer direction of the dosing conveyor 4. The mix of chips and binder falls through the slots between the rolls onto the belt of the scattering conveyor 8, which moves toward the direction indicated by the arrow and thus conveys the formed blanket of chips mixed with the binder to further processing by pressing (the pressing station is not shown, but it can be any conventional press).

Figure 2:
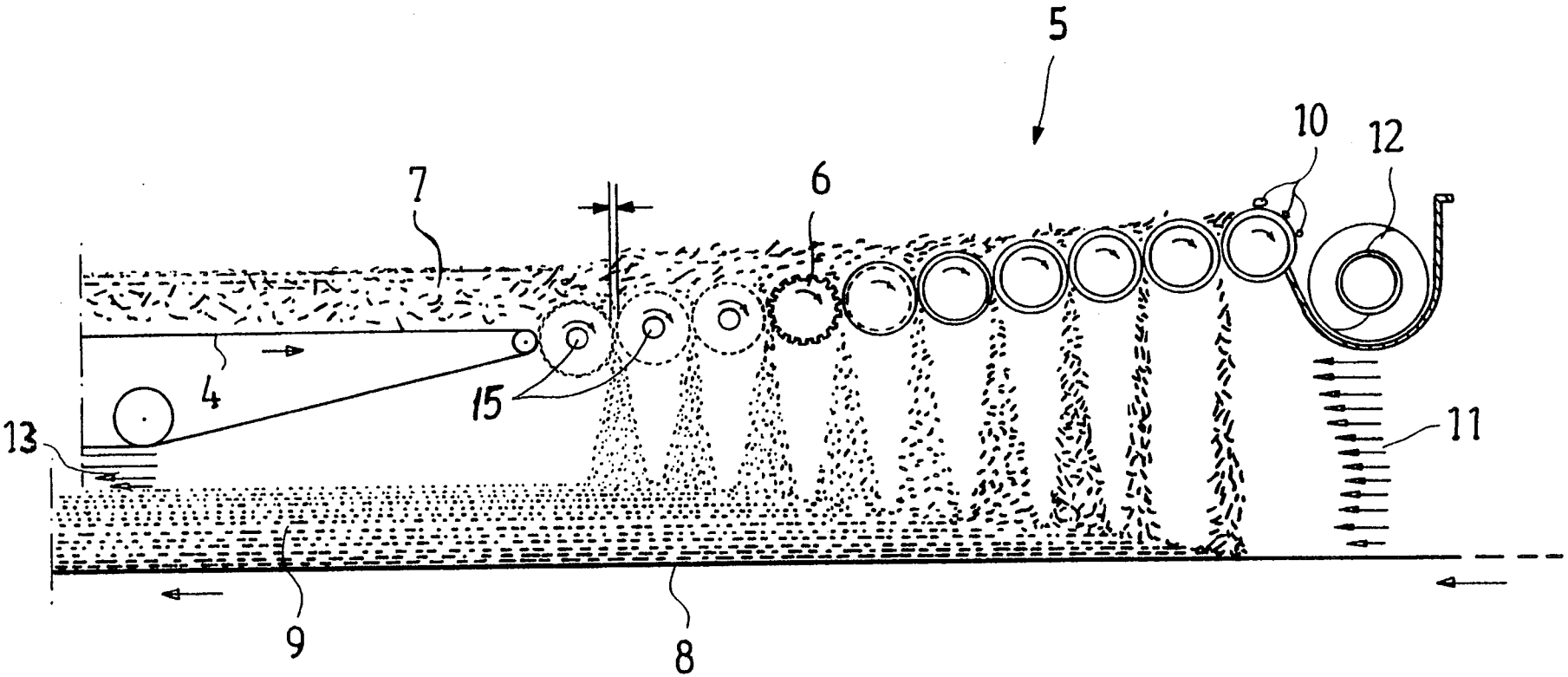
FIG. 2 shows in detail the roll set according to the invention.

The construction and function of the roll set 5 is illustrated in detail in FIG. 2. From the dosing conveyor 4, the chip blanket 7, which is formed and very effectively smoothed by the peg rolls, moves next onto the roll set 5. The finer fraction of chips tends right from the start to fall through the first slots between the rolls into the belt of the scattering band conveyor 8, or alternatively, onto a coarser fraction of chips already formed onto the belt. The ultimate goal is, of course, to attain a chip blanket 9 formed by a finer fraction of chips on the blanket's upper and lower surfaces, while the midpart of the blanket is formed of a coarser fraction of chips. This is achieved by the method illustrated in FIG. 2, whereby the coarser fraction of chips dominatingly falls through the slots between the rolls not earlier than at the exit end of the roll set, and in any case, on the average, at a later moment than the finer fraction of chips. FIG. 2 shows only one scattering assembly and the scattering result produced by it (that is, the finer fraction of chips on the outer surfaces and the coarser fraction in the middle). To achieve the final scattering result with a symmetrical distribution of the chips (with the finer chips on the outer surfaces and the coarser chips in the middle), also a second scattering assembly is required that must be located in a mirroring position (that means, to the right side of the station shown in diagram) above the scattering band conveyor 8. The scattering assembly placed in the mirroring position produces, of course, a scattering result with the coarser chips on the top surface and the finer chips on the bottom of blanket. This scattering arrangement in a preceding position on the conveyor 8 is not shown in FIG. 2.

Figure 3:
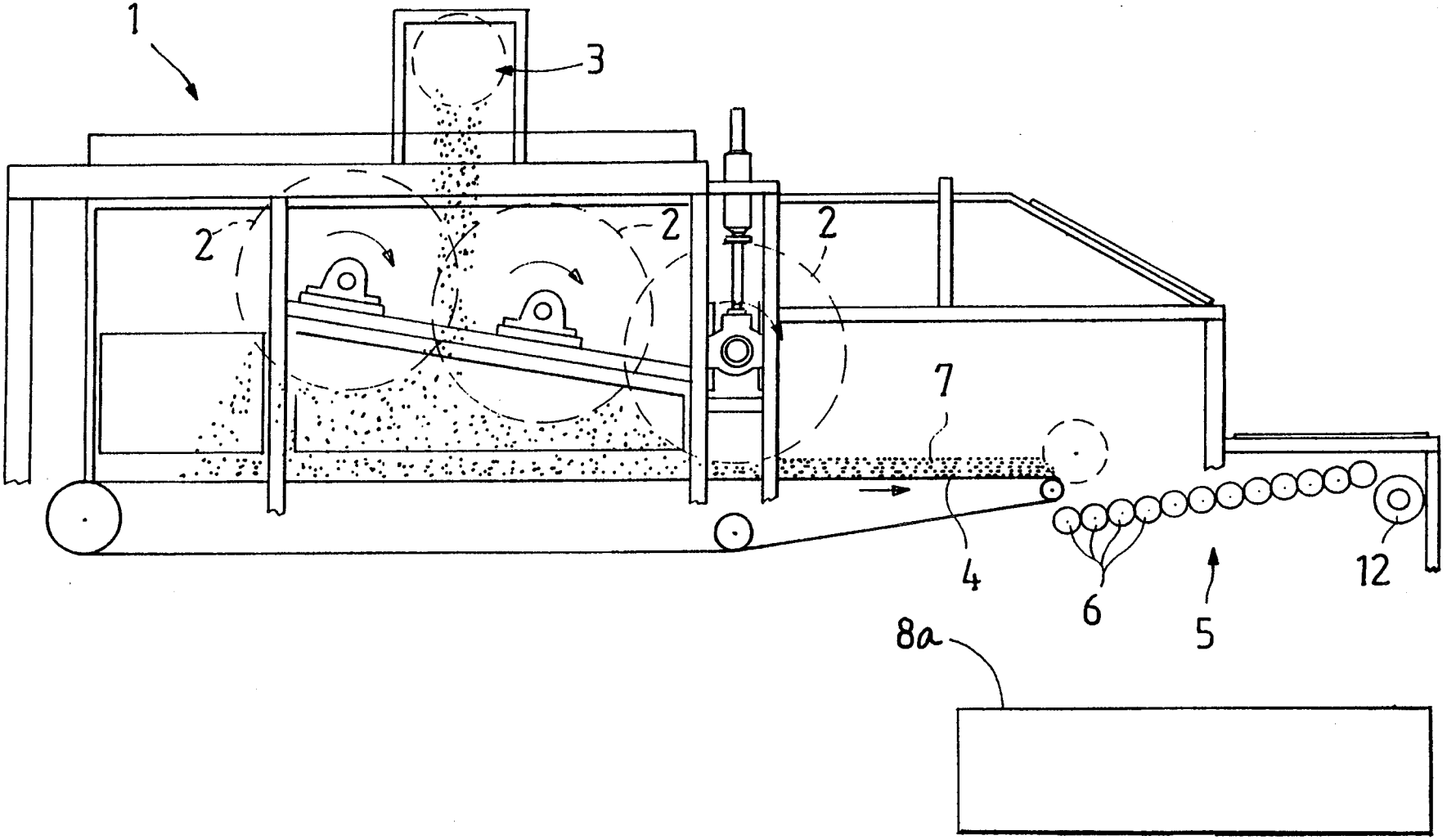
FIG. 3 is similar to FIG. 1 but illustrates the scattering chamber and the roll set of the invention in conjunction with a mold.

FIG. 3 shows a mold 8*a* which receives the mix of chips and binder fallen through the slots between the rolls 6, similarly to the arrangement of FIG. 1.

Figure 4:
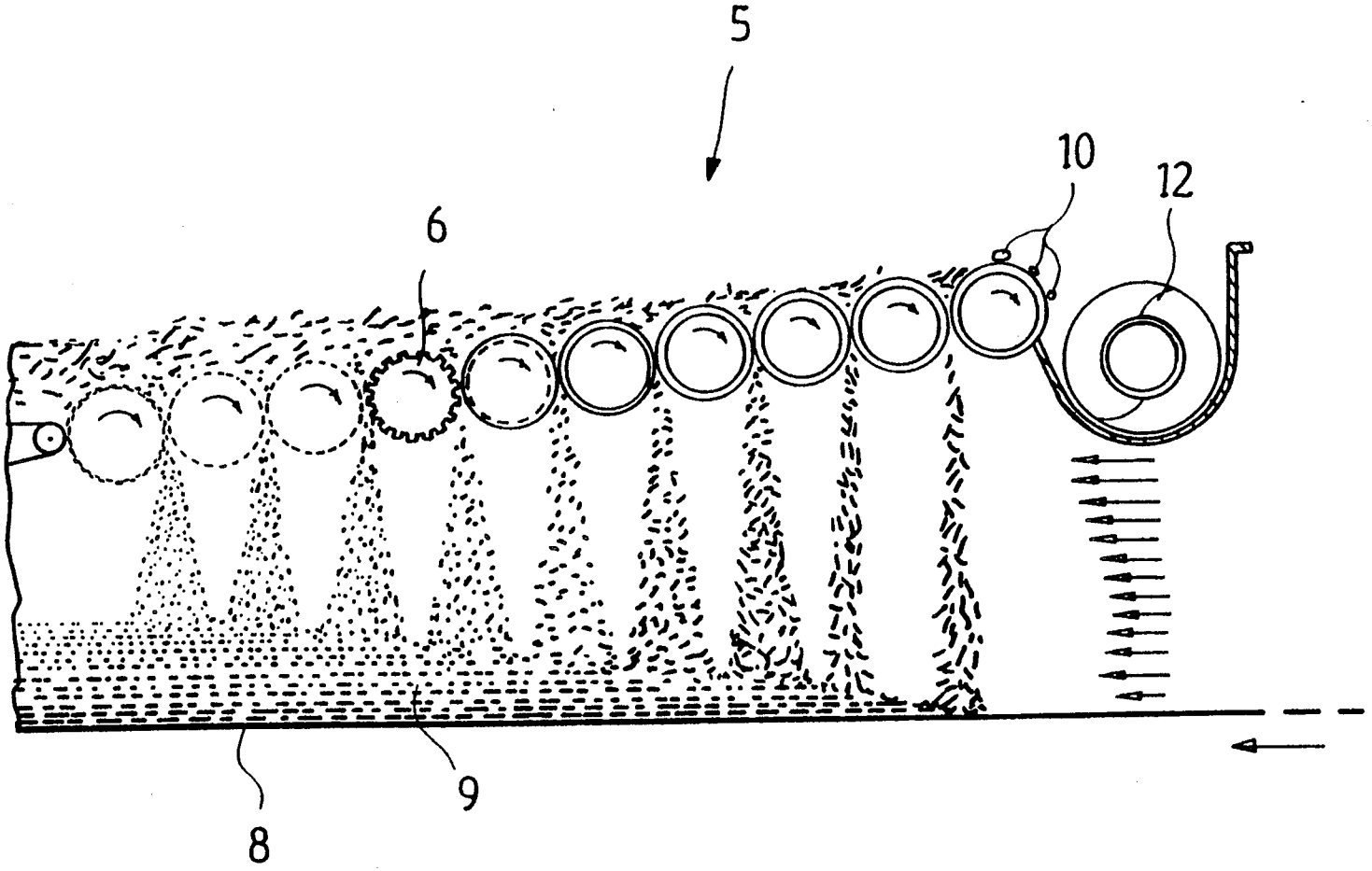
FIG. 4 is an enlarged view of the roll set, illustrating an increase in a slot width between the rolls towards the exit end of the chamber.

The roll set 5 is accordingly comprised of a plurality of rolls 6. According to the application, they can differ from each other in terms of, e.g., diameter, surface texture, direction and speed of rotation. Furthermore, the mutual elevation of the rolls can be varied. Different depths and shapes of the surface textures can be used on all the rolls. The surface texture can be grooved by milling, turning or resin casting techniques. Moreover, the rolls can be provided with cooling. In addition to variations in the properties of individual rolls, the slot widths between the rolls can be simply adjusted by moving shafts 15 (or a single shaft) of the rolls closer to each other or farther apart. In particular, the width of a each of the slots between the rolls can be individually adjusted, that means, the width adjustment of each slot is arranged to be independent of the other width adjustments. Herein the greatest advantage has been found in an arrangement having the slot widths increasing toward the exit end of the roll set, as shown in FIG. 4.

In FIG. 2 the roll set 5 is shown as an inclined plane. As is evident from the description above, the roll set need not lie in a plane. In all arrangements the slope angle of the planar roll set is also freely adjustable within a range of angles. A preferred range of adjustment spans, however, angles within 5°–20° with respect to the horizontal plane. In the embodiment illustrated in the drawings the plane formed by the roll set is aligned downward sloping so that the lowermost edge of the plane is at that end of the scattering chamber that houses the dosing conveyor.

In this embodiment, next to the roll set, as an extension, is arranged a screw conveyor or, similar conveyor 12 that removes reject particles 10 which have not passed through the slots between the rolls. Such rejects are, e.g., hard lumps of binder material or metal and other objects carried along with the flow of chips.

In order to attain higher capacity, the roll set according to the invention is advantageously complemented with, e.g., blower scattering means 11 or mechanical scattering. For the same purpose, the point indicated by arrow 13 in the drawing can be provided with vacuum suction. Furthermore, it is possible to complement the scattering arrangement with the apparatus by vacuum suction 13 alone, or alternatively, by a combination of air blowing 11 and vacuum suction 13.

For those versed in the art it is evident that the invention is not limited by the exemplifying embodiments described above, but instead, it can be varied within the claims of the invention. Omitted from the above-described illustrations are machineries and arrangements necessary for the implementation of rotational motions and different adjustments of the rolls, because these constructions can be assumed self-evident to those operating in the art. A complete production line of chipboard products requires naturally more than one scattering station of the kind according to the invention in order to accomplish the desired structure of a chipboard product. Also this fact is conventionally known in the art.

What is claimed is:

1. An apparatus for scattering fibrous material of different sizes, such as chips together with a binder, onto a receiving surface to form a precisely controlled blanket of said material, the apparatus compromising:

transfer means having an input and a discharge end, for transferring said material to be scattered toward said discharge end;

a set of movable rolls positioned proximate discharge end to receive said material from said discharge end of said transfer means, all of said rolls being mutually parallel and aligned transversely to a transfer direction of said material, said material moving over external circumferential surfaces of said rolls, the external circumferential surfaces of each two neighboring rolls being spaced from each other in said transfer direction to form slots therebetween, and being movable relative to one another so said slots can be adjusted to selected widths, the material being scattered through said slots onto said receiving surface, said rolls being positioned to provide progressively increased widths in said transfer direction of said slots between the rolls, said scattered material being of generally smaller size proximate said discharge end of said transfer means and becoming progressively larger in said transfer direction.

2. An apparatus as in claim 1, wherein the rolls are made of one of metal and synthetic material, and have a grooved surface texture produced by one of milling, turning, and resin casting.

3. An apparatus as in claim 1, wherein the rolls are aligned parallel in a single plane, said plane being inclined so that a lowermost edge of the plane is at said discharge end of said transfer means.

4. An apparatus as defined in claim 3, wherein a slope angle of the roll set is in the range of 5° to 20° with respect to a horizontal plane.

5. An apparatus as defined in claim 1, wherein the exit end of the roll set is complemented with a conveyor for removal of particles which have not been scattered through said slots.

6. An apparatus as defined in claim 1; and further comprising a vacuum suction means to complement scattering.

7. An apparatus as in claim 1, wherein said transfer means includes a scattering chamber having said discharge end and including a dosing conveyor for transferring said material to be scattered toward said discharge end.

8. An apparatus as in claim 1; wherein said receiving surface is one of a scattering band conveyor and a mold.

9. An apparatus for scattering fibrous material, such as chips together with a binder, onto a receiving surface to form a controlled blanket of said material, the apparatus comprising:

transfer means having an input and a discharge end for transferring said material to be scattered toward said discharge end; and a set of rolls positioned proximate said discharge end of said transfer means, all of said rolls being aligned mutually parallel and having external surfaces of each two neighboring rolls spaced from each other to form slots therebetween, the material being scattered through said slots onto said receiving surface, said rolls being positioned in said set so that the widths of said slots between the rolls increase in a transfer direction of said material over said set of rolls; and a combination of air blowing and vacuum suction means to complement scattering of said material.

10. A set of rolls for scattering fibrous material of different sizes, such as chips together with a binder, onto a receiving Surface to form a controlled blanket of said material, said material being delivered to said set of rolls at a discharge end of a transfer means, said set comprising:

movable rolls for receiving said material from said transfer means, all of said rolls being mutually parallel and aligned transversely to a transfer direction of said material, in operation of said rolls said material moving in said transfer direction over external circumferential surfaces of said rolls, the external circumferential surfaces of each two neighboring rolls being spaced from each other in said transfer direction to form slots therebetween and being movable relative to one another so said slots can be adjusted to selected widths for scattering said material through said slots onto said surface, said rolls being positioned to provide progressively increased slot widths between the rolls in said transfer direction thereby to deliver scattered material of increasing size in the transfer direction.

* * * * *

UNITED STATES PATENT AND TRADEMARK OFFICE

CERTIFICATE OF CORRECTION

PATENT NO. : 5,386,914

DATED : February 7, 1995

INVENTOR(S) : Markku Eramaja, Pentti Raura, Jarmo Sali

It is certified that error appears in the above-indentified patent and that said Letters Patent is hereby corrected as shown below:

On the title page, item [73] Assignee, please change the Assignee to read as follows:

--[73] Assignee: Sunds Defibrator Loviisa Oy, Valko, Finland--.

Signed and Sealed this

Eleventh Day of July, 1995

*Attest:*

Bruce Lehman

BRUCE LEHMAN

*Attesting Officer*

*Commissioner of Patents and Trademarks*